United States Patent [19]

Barra

[11] Patent Number: 4,913,432

[45] Date of Patent: Apr. 3, 1990

[54] ELECTROMECHANICAL REACTION-TIME GAME TOY

[76] Inventor: James M. Barra, 14802 Florida Ave., Apt. V-340, Tampa, Fla. 33613

[21] Appl. No.: 279,819

[22] Filed: Dec. 5, 1988

Related U.S. Application Data

[63] Continuation-in-part of Ser. No. 90,856, Aug. 31, 1987, Pat. No. 4,789,155.

[51] Int. Cl.[4] ..... A63B 67/00

[52] U.S. Cl. ..... 273/1 GC; 273/1 GE; 273/88; 273/138 A

[58] Field of Search ..... 273/1 GC, 1 G, 1 GE, 273/88, 138 A, 139, 93 R, 94, 85 R, 142 B, 141 A; 434/258

[56] References Cited

U.S. PATENT DOCUMENTS

| | | | |
|---|---|---|---|
| 1,393,494 | 10/1921 | Bryant | 273/142 B |
| 1,937,445 | 11/1933 | Smith | 273/1 GC |
| 2,141,948 | 12/1938 | Bruso | 273/88 |
| 2,881,892 | 4/1959 | Ylinen | 273/138 A X |
| 3,902,723 | 9/1975 | Colling et al. | 273/1 GE X |
| 4,060,242 | 11/1977 | Huang et al. | 273/1 GC |

FOREIGN PATENT DOCUMENTS

| | | | |
|---|---|---|---|
| 664535 | 6/1964 | Italy | 273/1 GE |
| 297536 | 9/1928 | United Kingdom | 273/1 GE |

*Primary Examiner*—Paul E. Shapiro
*Attorney, Agent, or Firm*—Charles A. McClure

[57] ABSTRACT

A competitive game toy for one or more players, dependent on personal reaction time and hand-eye coordination. Players manually trigger the driving of movable indicator arms along a path having successive intervals marked with award indicia of any desired game or sport, and also manually halt the indicator therealong. In a variant players manually trigger successive actuation of electrical indicator lights along such a path having intervals lighted thereby in accordance with movement of an electrical contactor therealong. The intervals are marked with award indicia of any desired game or sport, and may be point scores or instructions to add or delete turns or for simulated playing of a game or sport, such as baseball. The players striving to be awarded a high score or good play, try to stop at or light up path intervals bearing favorable indicia.

21 Claims, 4 Drawing Sheets

FIG. 5
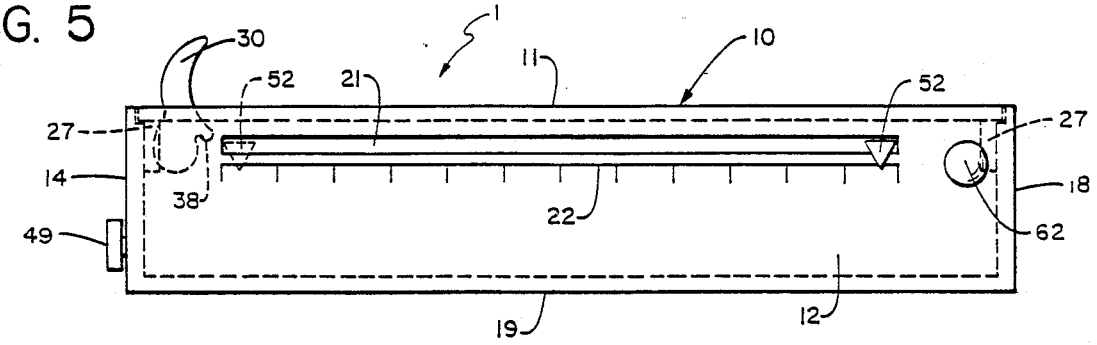
FIG. 6
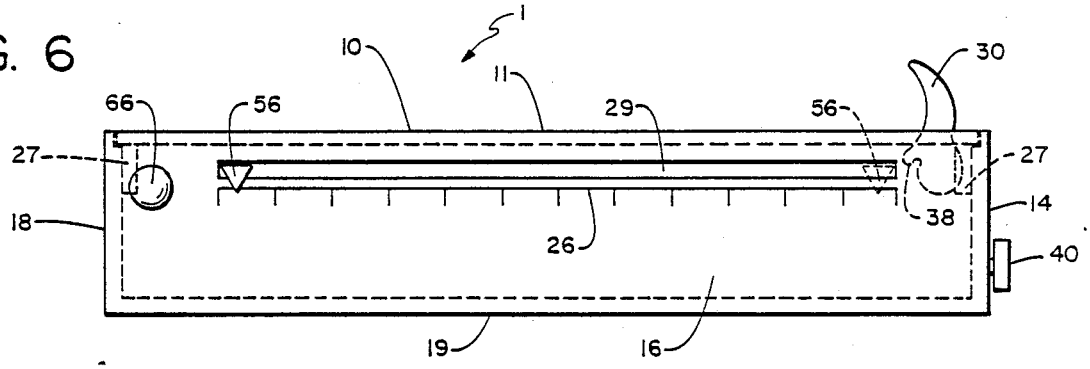
FIG. 7
71A
| | | | | | | | |
|---|---|---|---|---|---|---|---|
| +5 | -10 | +1 | +1 PLAY | -1 PLAY | +10 | +20 | -10 |
FIG. 8
71B
| | | | | | | | | | | | |
|---|---|---|---|---|---|---|---|---|---|---|---|
| -10 | +5 | -5 | +2 | -2 | +10 | -10 | +2 | -2 | +5 | -5 | +10 |
FIG. 9
75A
| | | | | | | | | |
|---|---|---|---|---|---|---|---|---|
| INTENTIONAL WALK | CONTACT | WILD. PITCH | STRIKE | BALL | CONTACT | STRIKE | BALL | CONTACT |
FIG. 10
75B
| | | | | | | | | | | | |
|---|---|---|---|---|---|---|---|---|---|---|---|
| HOME RUN | OUTFIELD FLY | GROUND-RULE DOUBLE | GROUND OUT | SINGLE | POP FLY | BUNT SAFE | LONG SINGLE | BUNT OUT | FOUL FLY | TRIPLE | DROPPED FOUL |

ELECTROMECHANICAL REACTION-TIME GAME TOY

This application is a continuation-in-part of my similarly entitled copending patent application, Ser. No. 90,856 filed on Aug. 31, 1987, issued as U.S. Pat. 4,789,155 on 6 December 1988.

FIELD OF THE INVENTION

This invention relates to a toy for playing a competitive game such as a simulated sport alone or with one or more opponents, and concerns especially a time-reaction toy having a manually triggered indicator that is also manually arrested for selecting points to be scored or plays to be made.

BACKGROUND OF THE INVENTION

Competitive game toys diverge toward two diverse classes, game boards with chance-related play determinants (e.g., dice, spinners) and complex structurally modeled simulations, such as car or horse races. A gap exists for game toys with which players may exercise an important physical skill to determine plays in simulated sports and game points otherwise. One such skill is hand-eye coordination; another is reaction rate. My competitive game toy is designed to improve such physical skills, while leaving considerable scope for mental prowess in playing a simulated sport or other game of skill.

SUMMARY OF THE INVENTION

In general, the objects of this invention are attained via drive means adapted to be manually triggered to traverse movable indicator means along at least one path divided into successive intervals, and stop means adapted to be manually actuated to halt the indicator therealong. The drive means is controlled by manual setting and releasing of trigger means and by manual actuation of the stop means, usually before the drive means has traversed the indicator means from end to end along such path.

A primary object of the present invention is to improve each player's hand-eye coordination and rate of reaction.

Another object of this invention is to provide a competitive game toy usable by either one player, two players, or even more than two players.

A further object of the invention is to make such toy suitable for players of low, intermediate, and high physical skill levels by providing ready adjustability of the indicator traversing rate.

Yet another object is to extend this invention to an electromechanical embodiment to supplement my previous development of a wholly mechanical embodiment.

Other objects of this invention, together with methods and means for accomplishing the various objects, will be apparent from the following description and from the accompanying drawings of a preferred embodiment and variants thereof, which are presented here by way of example rather than limitation.

BRIEF DESCRIPTION OF THE DRAWINGS

FIG. 5 is a side elevation of a first side of the same toy, as indicated at V—V on FIG. 1;

FIG. 6 is a side elevation of the same toy from the opposite side, as indicated at VI—VI on FIG. 1.

FIG. 7 is an elevation of a first embodiment of game indicia for the front side of this toy;

FIG. 8 is a like view of a first embodiment of game indicia for the rear side of the same toy;

FIG. 9 is a like view of a second embodiment of game indicia for the front side of this toy; and FIG. 10 is a like view of a second embodiment of game indicia for the rear side of the toy.

DETAILED DESCRIPTION OF THE INVENTION

Figure 1:
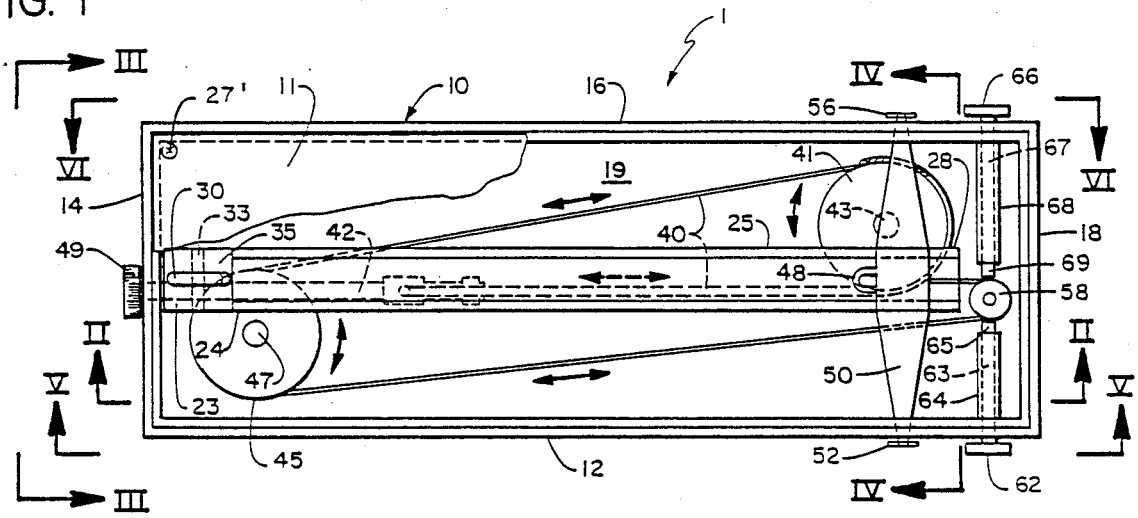
FIG. 1 is a top plan view, mostly sectioned away to reveal interior components of a game toy of the present invention.

First embodiment 1 of the toy of this invention has housing 10 with rectangular parallelepipedal shape, flat top 11 and bottom 19, front sidewall 12, left endwall 14, rear sidewall 16, and right endwall 18. The housing contains much of the trigger means, and the drive means, indicator means, and stop means.

Figure 2:
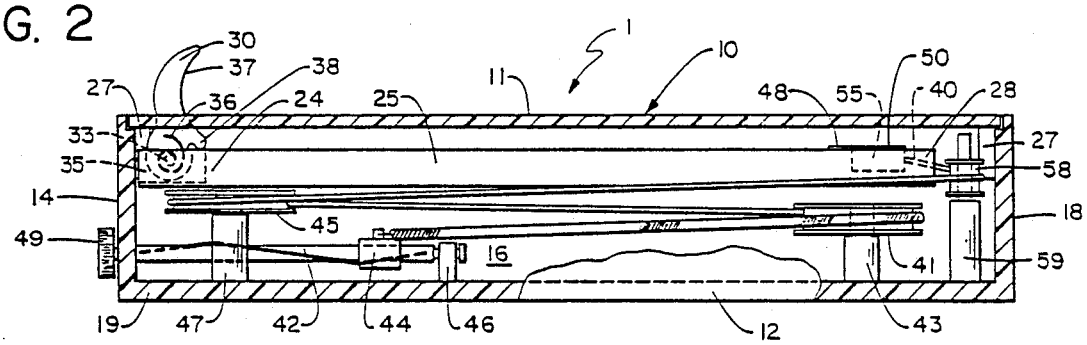
FIG. 2 is a front side elevation, mostly sectioned away to reveal the interior of the same toy, as taken at II—II on FIG. 1.

FIG. 1 shows such housing in plan. Its top panel 11, mostly cut away here, is held at the corners by screws 27' (one visible) into underlying bores 27 (shown in FIG. 2 and successive views). FIG. 2 shows the same housing with near wall 12 also mostly absent.

Centered between front wall 12 and rear wall 16 is open-top track 25 of the drive means. The track is secured at its left end 24 to housing left wall 14, leaving its right end 28 spaced near right wall 18. Support block 35 of the trigger means is fixed in the left end of the track and carries trigger 30 thereon upright on pivot pin 33. The trigger extends in a crescent shape above the top of the housing, with its concave face or grip 37 facing right, and biased clockwise toward the set position by torsion spring 36. Detent 38 at the lower right part of the trigger is adapted to fit (when set) into eye 48 of the drive means on intervening diamond-shaped part 50 of the indicator means, shown here at the right.

At the left, in FIGS. 1 and 2, just outside the housing, is tension-adjustment knob 40 of the drive means, which is attached to control screw 42 (shown schematically) extending underneath the track somewhat less than half the track length to terminate in supporting journal 46 upstanding from bottom 19 of the housing. This screw is rotatable to adjust therealong the longitudinal location of sleeve 44, connected to one end of drive cable 40

(shown in broken lines). The cable is elastically extensible over at least part of its length, conveniently the part between the end of the adjustment screw and pulley 41 at the right.

Under the right end of the track (FIGS. 1, 2) cable 40 wraps substantially a half turn about pulley 41 on support 43 upstanding from the bottom of the housing and offset between the track end and wall 16; then the cable extends obliquely for most of the housing length and wraps substantially a half turn about pulley 45, which is similarly mounted on upstanding support 47 at a somewhat higher level just underneath—and offset from—the left end of the track toward wall 12; and then the cable extends obliquely and nearly parallel to its previous oblique segment to wrap almost a half turn about small roller 58 mounted on upstanding support 59 between free end 28 of the track and wall 18.

The indicator means includes diamond-shaped winglike part 50, shown supported on slide 55 near rightmost end 28 of the track. Such winglike part extends laterally from above the track to and just past front and back sides 12 and 16 of the housing (FIG. 2), where it terminates in downturned pointer-like ends 52 and 56. Slide 55, inside the track, has affixed to it the end of cable 40 from about adjacent small roller 58. The opposite edge of the winglike part carries eye 48 into which detent 34 of the trigger means engages to set the trigger when the indicator is returned manually to the set position—stretching the extensible portion of the cable and thereby increasing the tension in it.

At the extreme right in FIGS. 1, 2 are pair of shafts 63, 67 extending through respective sleeves 64, 68 from respective stop buttons 52, 56 at the outside to terminate at free ends 65, 69, where friction can be applied to cable 40 to halt its travel after trigger 30 has been pivoted by application of manual pressure to its grip 37, thereby lifting detect 38 out of eye 48 on the near edge of the winglike means, freeing the extended cable to retract.

Figure 3:
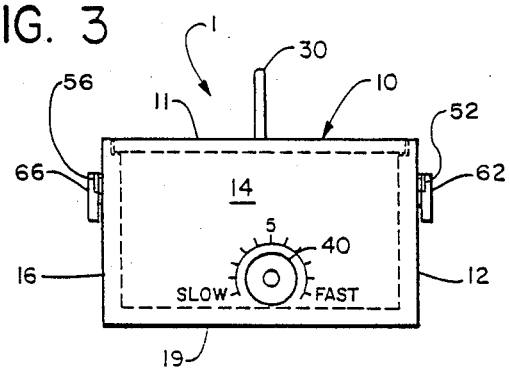
FIG. 3 is an end elevation of this toy, taken as indicated at III—III on FIG. 1.

FIG. 3 shows housing end 14, with adjustment knob 40, shown as making nearly a whole turn from LOW through "5" to HIGH on the adjacent scale, intended to correspond to full travel of slide 44 the length of screw 42—which rotates as the knob is turned. Near the facing end, grip 37 of trigger 30 protrudes above the top 11 of the housing. Closer to the far end, indicator pointers 52 and 56, carried by winglike indicator part 50, closely flank sides 12 and 16.

Figure 4:
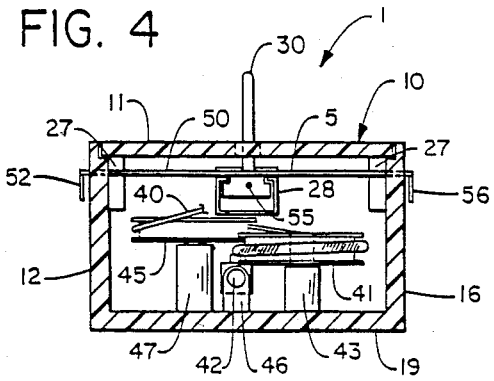
FIG. 4 is a sectional transverse elevation of the same toy, taken near one end thereof, as indicated at IV—IV on FIG. 1.

FIG. 4 shows the pulleys and the path of the cable thereabout in an endwise sectional view looking straight back down the track from the free end 28 thereof. In this view, pulley 41 is lower and on the right, whereas pulley 45 is at an intermediate level and on the left, while winglike part of the indicator means is above both pulleys. the sectioned top, bottom, and sides of the housing are shaded for plastic, although wood and metal would be acceptable housing compositions instead of or in addition thereto.

FIG. 5 shows long side 12 of the toy housing in elevation. Visible paralleling top 11 and bottom 29 (closer to the former) is slot 21 through which the near end of the wing part protrudes and terminates in downturned pointer 22, below which is parallel game indicia panel 22—blank here. At the right of the view, near end 18 and between side 12 and the viewer, is stop means 62, and at the left of end 14 is cable length-adjustment knob 60. Shown in broken lines at the left end of slot 21 is pointer 52, which is its alternative set position before the trigger is pressed.

FIG. 6, which shows long side 16 in like manner as FIG. 5 shows long side 12, is physically a mirror image of FIG. 2 but with most of the reference numerals different, of course. Thus, visible paralleling top 11 and bottom 29 (closer to the former) is slot 29 through which the near end of the wing part protrudes and terminates in downturned end 56, which points toward parallel game indicia panel 26—blank here. At the left of the view, near end 18 and between side 16 and the viewer, is stop means 66, and at the right of end 14 is cable length-adjustment knob 60. Shown in broken lines at the right end of slot 29 is pointer 56, which is its alternative set position before the trigger is pressed.

No special materials of construction are required in the practice of this invention. A rubber band or helical extension spring is suitable for the drive means. The part of the cable contacted by the stop means may be specially coated, cored, or wrapped for ease of stopping and for increased durability, and the ends of the stop means made rough or pointed, for example. Leather is durable and is readily halted by pointed stop means.

Operation of the game toy, insofar as described, is readily understood. If the trigger is not set, a user of the toy holds the housing at the bottom or at the end near the trigger with one hand, takes the pointers between thumb and finger of the other hand and forces them—and the rest of the indicator means—back upstream, i.e., toward the end near the trigger, stretching and thereby tensioning the extensible part of the cable in the process.

During the setting of the trigger, as the the eye on the slide of the indicator means encounters the curved edge of the trigger detent, the trigger will pivot against its spring bias suficiently to admit the eye to be engaged by the detent (or the trigger can be held open momentarily by the player's other hand) whereupon the bias then forces the detent into the eye, holding the drive means in the set or ready position.

Whenever the user applies sufficient manual pressure to its concave grip, the trigger pivots and thereby releases the eye of the indicator means, whereupon the extended cable retracts so that the drive means traverses the indicator means rapidly toward the opposite end of the track. During the brief travel time of the triggered indicator means, the user may undertake to half it before the indicators reach the downstream end of their slots, by pressing one or both stop buttons so forcibly as to bind the cable against the roller. However, if the user's reaction time is too slow, the pointers may well reach the end of their path before the user succeeds in stopping them. Practice should speed up the reaction so as to enable the indicators to be halted sooner.

The game aspects of the toy relate to the user's ability to halt the indicator means as it is driven by the drive means, so that the pointer(s) will point to a desirable outcome on the indicia panel(s) provided as award means just underneath and paralleling the pointer travel slot(s). Convenient division of the indicia panel(s) into at least about a half dozen and at most about a dozen intervals enables such indicia as game points, play steps, or other instructions to be identified with whatever indicia interval is pointed to by either particular pointer when halted by a player pressing on one or both stop buttons.

FIGS. 7 and 8 show a first or "point score" embodiment, and FIGS. 9 and 10 show a second or "baseball"

embodiment of indicia panels for the respective front and rear sides of the game toy of this invention, it being understood that only one side need be used but that use of both sides enables a game to be made more intricate and, therefore, more likely to remain interesting.

For each game one or more appropriate award means strips are selected by the player(s) and are secured in register with the indicia marks on the toy walls. Guides may be added on the walls to retain the panels in place. Alternatively, the backs of the panels or the receptive parts of the walls may be coated with a reusable adhesive, or both may be covered with mating "Velcro" strips or the like to permit frequent changing of such panels.

One user may play in solitary competition or skill training, releasing the trigger, stopping the pointer(s), noting the award, resetting the trigger, and so on—using one or two indicia panels as may be preferred. Alternatively, two users may play against one another by passing the game toy back and forth between plays, usually only one play each if using only one award means indicia panel but usually more plays each if using two indicia panels.

It will be understood that, when there is only one player, an added play (when awarded) may be taken simply by taking another turn with the same indicia panel or, if desired, with an available second indicia panel. Also, although a single indicia panel can be replaced by another between plays, it is distracting and slows the game to do so, so two indicia panels in place continuously are more convenient--except whenever the game in use is to be changed.

FIG. 7 shows indicia panel 71A divided into eight separate intervals labeled "+5, −10, +1, +1 play, −1 play, +10, +20, −10."

FIG. 8 shows indicia panel 71B having a dozen intervals: "−10, +5, −5, +2, −2, +10, −10, +2, −2, +5, −5, +10."

Play using the award means of either or both of FIGS. 7 and 8 is apparent. With only the indicia panel of FIG. 7, a single player takes successive turns and preferably keeps a running point score. With the indicia panel of FIG. 8 added, the same player uses such second source of point scores when the first indicia panel awards another turn. When there are two (or more) players, they play the first panel alternately, resorting to the second panel before relinquishing the toy to the opponent only when awarded another turn on the first panel.

FIG. 9 shows indicia panel 75A having indicia pertinent to the batter's situation in relation to pitches in baseball: "intentional walk, contact, wild pitch, strike, ball, contact, strike, ball, contact." Players will understand that "contact" means the bat struck the ball—the outcome of which is to be decided separately by another play on a second indicia panel, as in the next view, either by the same or a different player.

It will be apparent that, where the game is baseball, the toy preferably has two award panels alongside two respective indicator paths, one with instructions simulating offensive play and another with instructions simulating defensive play. A lone player plays successively both offense and defense along the respective paths. Alternatively, when there are two players, they play respective offensive and defensive play-simulating instructions for a while. Usually the respective positions are reversed after every three outs, corresponding to team changes between batting and fielding.

FIG. 10 shows indicia panel 75B with "contact" indicia: "home run, outfield fly, ground-rule double, ground out, single, pop fly, bunt safe, long single, bunt out, foul fly, triple, dropped foul." It will be understood that every fly is an out unless noted as dropped—when it is a single unless noted foul (when it is a strike, and play resumes on panel 75A). A runner on second base cannot score on an ordinary single or a ground-rule double—but runners on base advance two bases on a long single or a regular double. A game board showing a baseball diamond in plan can be furnished along with baseball player pieces, etc.

It will be further apparent that this game toy can be adapted to other two-sided games, such as tennis or soccer, by appropriate changes in the indicia panels; and to many-sided games, as well, such as arbitrary journeys with various hazards and rewards.

Regardless of whether a player is simply competing with the toy—so to speak—or himself or herself (when playing alone) or is competing against one or more other persons, the degree of difficulty can be selected by setting the tension adjustment knob appropriately. A high setting increases the tension and, thus, produces a more rapid rate of travel of the indicator pointers when triggered, thereby increasing the level of skill required to stop either one at a desired location along the award indicia.

In addition to the all-mechanical embodiment just described, an electromechanical embodiment may be added or be substituted, in which some manual operations not involved in a reaction-time step can be performed electrically, such as the resetting of the moving mechanism. In addition, electrical indicator lights may be substituted for the moving pointer to indicate ambiguities that in each run--and have the advantage of avoiding ambiguities that may be encountered with pointer position when on the dividing line between two unlike reward indicia.

FIGS. 11 through 15 show an electromechanical embodiment of this invention. Inasmuch as many of the component features of this second embodiment have close counterparts in the preceding embodiment, such corresponding features of this embodiment are designated in the text and/or in the drawing views by reference numerals greater by one hundred than the reference numerals for the counterpart features of the previous embodiment. Features having no such counterpart are designated by numbers in the 100 series for which no corresponding number less by one hundred was used in designating features of the previous embodiment. This enables unnecessary repetition to be minimized in the following description, it being understood that designation of like or analogous features by such pairs of numbers (e.g., cable 140 in this embodiment and cable 40 in the previous embodiment) is so self-explanatory as to require little or no further comment.

Figure 11:
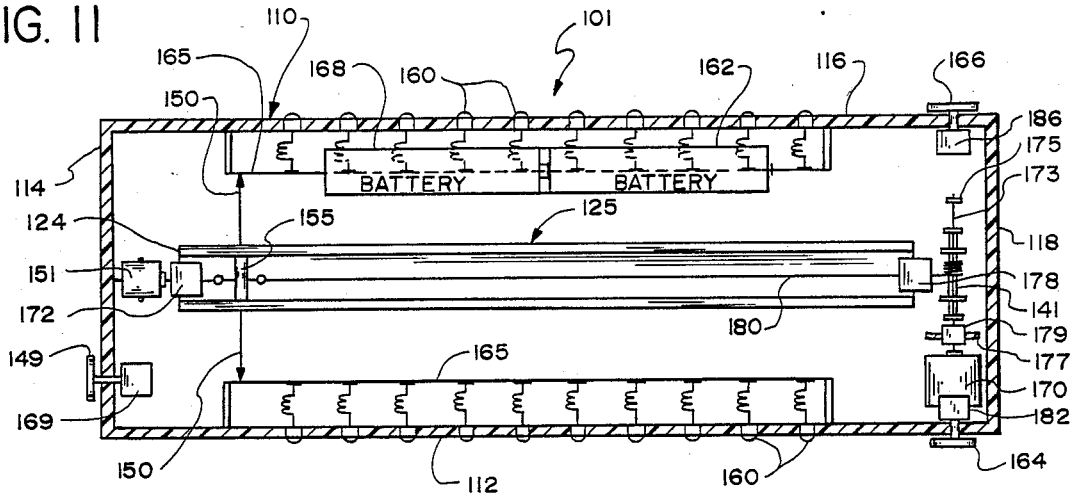
FIG. 11 is a top plan view, similar to FIG. 1, showing similar features of another embodiment of game toy of the present invention.

FIG. 11 shows embodiment 101 of the competitive game toy of this invention from above, less the cover of housing 110, which is sectioned away to reveal the interior. Prominently visible are track 125 extending lengthwise from near one end to near the opposite end. The track is flanked by a pair of spaced contact strips 160, 160′ to which winglike double-ended contactor 150 of movable indicator means extends from slide 155 visible near left end 124 of the track, which has safety switches 172 and 178 at its left and right ends, respectively.

Spaced at intervals along each of opposite sides 112 and 116 of the housing is a row of visual indicators 160, conveniently in the form of spaced light-emitting diodes or LEDs. Continuous striplike rows of liquid-crystal display (LCD) can be substituted for the LEDs. Each LED has one lead to a short part of the length of contact strip 165, mounted offset from the near sidewall, and another (not shown) in contact with a strip of conductive foil (or equivalent electrical conductor—not separately shown here) on the inside of the sidewall.

Figure 12:
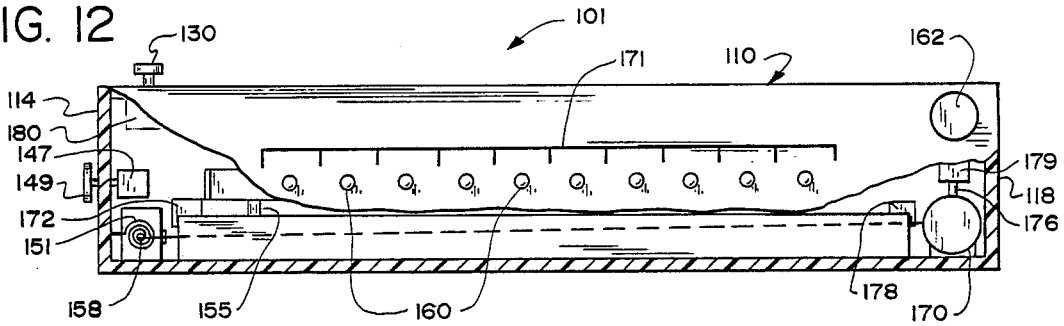
FIG. 12 is a front side elevation, partly cut away, of such latter embodiment, similar to FIG. 2 of the former embodiment.

In general, a given pair of LEDs on opposite outside walls of the housing will light as double-ended contactor 150 passes by them or stops between them, as will become further apparent when the method of operation is discussed below. As shown in FIG. 12, above each row of indicator lights is indicia strip 171—one such strip on each outside wall of the housing—subdivided into successive parts or sections (wording omitted). Trigger 130 is visible above the left end of the housing in FIG. 12, and rotary switch 180 partially so just underneath it inside. Pair of stop buttons 162 and 166 are protruding from the opposite sidewalls near the upper corner at the opposite end, and stop switches 182 and 186 are just inside.

As the electrical components are detailed in a later diagram, this view shows in addition to the foregoing only speed-control rheostat 147 inside the left end of the housing near external speed-control knob 149, pawl-release or reset solenoid 179 above ratchet gear 177 on the shaft of motor 170, and pair of series batteries 168 located above part of the contact strip near housing sidewall 116.

As shown in one or both of FIGS. 11 and 12, cable 140 extends all the way from drive drum 141 located within housing end 118 to takeup storehouse 151 located just inside opposite end 114 of the housing. Torsion spring 152 at the latter end maintains the cable under enough tension to wind it about axle 153 in the storehouse whenever the toy is reset (motor off) while the cable is extended. Motor shaft 173 is supported in journals 175, and carries drive drum 141 onto which cable 140 is wound when the motor is actated to turn the drum. Pawl 176 overlies ratchet gear 177 and when engaged (by gravity and/or spring bias—reset solenoid off) prevents the withdrawn cable from being rewound by the tension of spring 152, as is considered further in the statement of operation below. Not shown here is a bias spring to assist gravity in maintaining pawl 176 engaged with ratchet gear 177 except when disengaged by its solenoid during resetting of the slide for another run.

Figure 13:
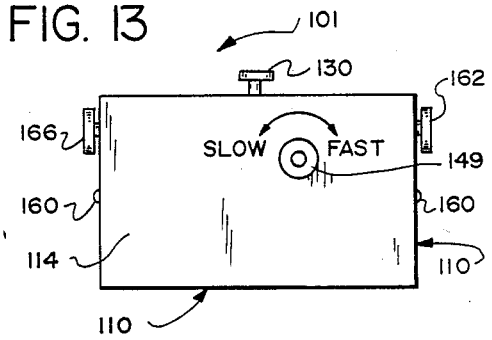
FIG. 13 is a transverse elevation taken inside but closer to one end thereof, otherwise like FIG. 3 of the former, embodiment.

FIG. 13 shows in elevation what was the left end of housing 110 in the preceding two views of embodiment 101. Protruding from the top center is trigger button 130, and protruding from the sides are stop buttons 162 at the right and 166 at the left. Indicator lights 160 at the respective sides are barely visible. Prominent on near end 114 is speed-control knob 149 with a scale from SLOW to FAST.

Figure 14:
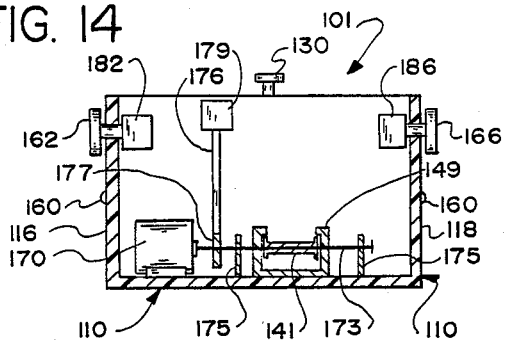
FIG. 14 is an elevation of the opposite end, similar to FIG. 4 of the former embodiment.

FIG. 14 is a view, partly in section, looking in the opposite direction from just inside the opposite end. Components beyond the plane of the view are omitted in the interest of clarity. Drum 141 (shown less cable here) is supported on stand 149 and has motor shaft 173 extending through it. Stop buttons 162 and 166 and their respective solenoids 182 and 186 are visible at the upper corners. Reset solenoid 179 is located above pawl 176 (engaged in gear 177).

Figure 15:
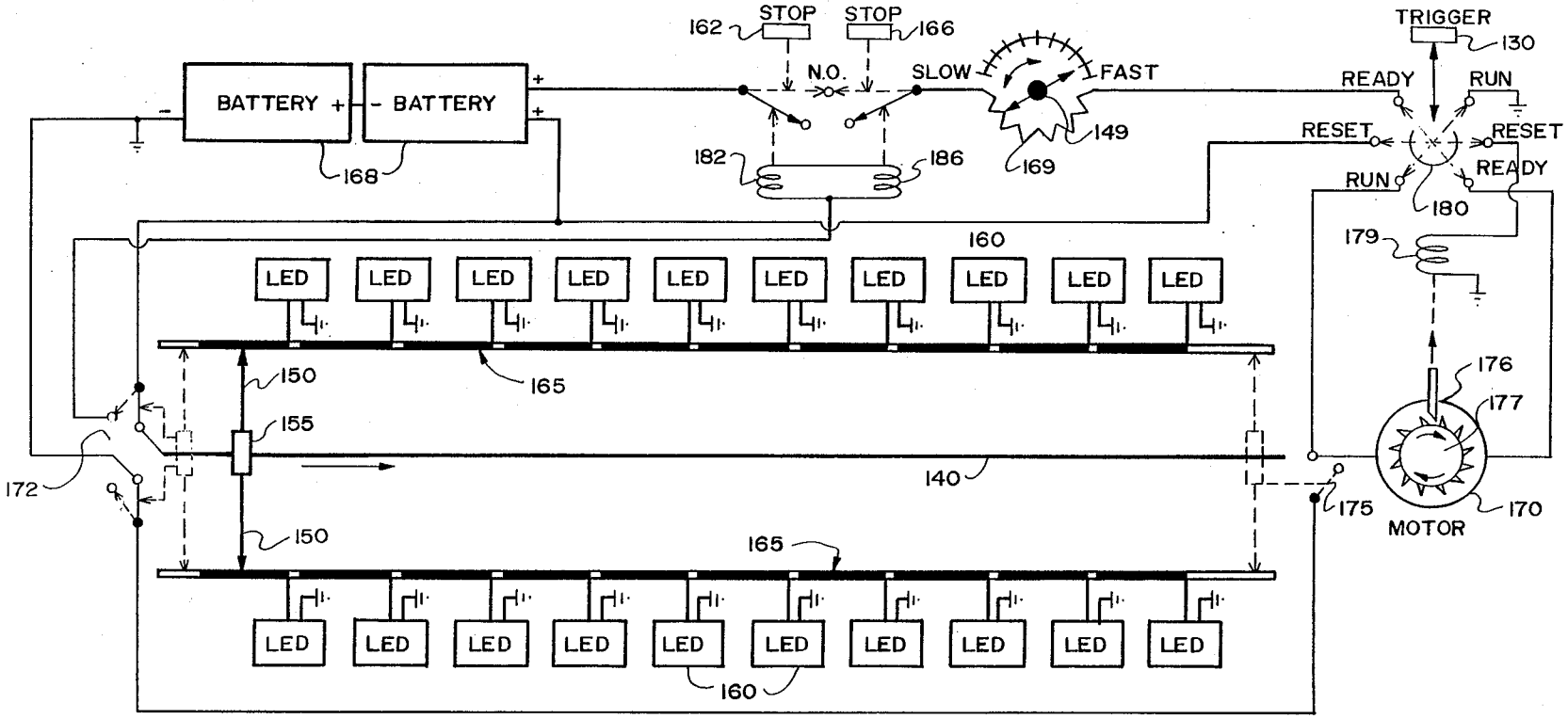
FIG. 15 is an electrical schematic of the latter embodiment.

FIG. 15 shows schematically electrical components and diverse interconnections for embodiment 101 of FIGS. 11 through 14. Here movable components, such as the slide with its contactor and the contact arms of switches, are represented by solid lines in a given position (usually the normal position) and in broken lines in one or more other positions. At the upper left are pair of batteries 168 connected in series, and with a negative ground. Cable 140, shown horizontal, is flanked above and below by rows of ten LED's 160, one row above and one row below parallel horizontal contact strips 165. Each LED has two leads, one grounded and the other attached to an adjacent conductive portion of the nearby contact strip. Each of the contact strips has ten narrow non-conductive (unshaded) portions alternating with ten wide conductive (shaded) portions, one shaded portion per LED, between the opposite ends, where they terminate in wider non-conductive end portions. Winglike double-ended contactor 150 extends from slide 155 into contact with both contact strips. Cable 140 is shown attached to the slide, but its ends are cut off, and the track is omitted entirely, for clarity of the view.

The controls previously mentioned are located along the top of this view to the right of the batteries and are considered here from left to right. Upper and lower positive leads from the rightmost battery are in the motor circuit and reset circuit, respectively. The motor circuit includes hand-operated STOP buttons 162 and 166 and adjacent normally open (N.O.) switch arms adapted to be closed by solenoids 182 and 186, which are in the reset circuit, and to be reopened manually. Also in the motor circuit is speed-control 169 having resistor and knob 149 (with FAST-SLOW scale), connected to the lefthand READY terminal of three-position rotary switch 180, which is actuated by TRIGGER pushbutton 130. The righthand READY terminal is connected to one side of the motor (winding not shown), and the other side is connected through the switch pivot of right safety switch 178 to the lower switch pivot of left safety switch 172, both shown in closed position, and to ground at the negative (−) battery terminal. It will be understood that each time that the manual TRIGGER pushbutton is depressed the rotary switch arm interconnects the next (clockwise direction) pair of its (six) opposed contacts into an appropriate circuit, indicated by the designations, RESET, READY, and RUN juxtaposed to the contacts.

The upper switch arm of the left safety switch is connected, when the switch is in the illustrated closed position, to provide positive voltage between a positive battery terminal to the LEDs, as shown schematically here by a connection to cable 140 attached to slide 155 carrying contactor 150. Such function is preferably performed by a flexible ribbon lead (not shown here) separate from the cable and having one end fixed to the switch contact and the other end moving along with the slide, in like manner as a moving printhead is conventionally powered on most computer printers.

When the upper switch arm of the left safety or limit switch 172 is switched to its alternative left contact (by the slide at its left limit position) it closes the reset circuit to one end of the windings of STOP solenoids 182 and 186, whose other end is grounded. The same positive lead connects to the lefthand RESET terminal of trigger-actuated rotary swich 180. The righthand reset terminal is connected to one end of the winding of pawl-lifting lifting solenoid 179, whose other end is grounded.

The third pair, or RUN, terminals of the rotary switch are connected between the left or normally open contact of righthand safety switch 178 (left RUN contact) and ground (right RUN contact). The safety switches themselves are shown in the normally closed (N.C.) vertical position and are opened by movement of slide 155 at the respective extremes of its travel along the track.

Operation of this electromechanical embodiment of the invention is readily understood. At the end of a run, the next step is to reset the game toy for the next run, whether done soon afterward or deferred until a later playing session. It is assumed that one or both of the STOP buttons were depressed to stop the motor and the slide being pulled by it in the previous run, although if a long period of time has elapsed since the last previous run the slide preferably would have been stowed at the extreme right end of its travel, as recommended later in this specification.

A play manually depresses the trigger pushbutton, thereby moving the rotary switch arm from the RUN position to the next or RESET position, whereupon the pawl-lifitng solenoid lifts the pawl from contact with the ratchet gear on the motor shaft, and the spring takes up the extended length of cable, moving the slide to the extreme left end of the track, there opening both switch arms of the safety switch, and thereby removing the positive voltage from the lights and applying it to the STOP switch solenoid to reclose the switch arms to restore the motor circuit up to the open READY terminals of the rotary switch. The lower switch arm is also opened by the slide at the extreme left position to break the motor circuit there as a precaution against starting up the motor before either the play—or the rest of the apparatus—is completely ready.

To put the toy in a READY condition for the next run, the player then manually depresses the pushbutton again, connecting the motor circuit through the READY contacts of the rotary switch as far as the switch arm just opened by the slide at the left. When the player is ready, depressing the pushbutton again switches the rotary switch to bridge the RUN contacts and thereby complete the motor circuit irrespective of the open position of the left safety switch. As soon as the motor winds a bit of the near end of the cable the slide is pulled away from its extreme left position, closing both the upper and lower switch arms, removing the actuating voltage from the STOP solenoid (so the STOP buttons can be actuated manually) and completing the motor circuit independently of the RUN contacts.

If a player allows the slide to travel to the extreme right end of the track, the right safety switch opens and thereby breaks the motor circuit. In normal play, however, the player breaks the motor circuit by depressing one or both of the STOP switches, whereupon the slide stops and its double-ended contactor completes the circuit to one LED on each side at a given position on each scale (which is read to determine a play or score, as in the previous embodiment).

This may be the most likely condition for a player to leave the toy in at the end of a playing session, with only a pair of lights connected in the circuit. Alternatively, the player might switch to the RESET position, which nergizes the STOP solenoid only. As a precaution ainst draining the battery, however, the player should stow the slide at the full extent of its RUN travel, without use of the STOP buttons. Such position removes all current drain from the batteries. If desired, a control device—not shown—can be added to disconnect the batteries after a given period of time in which no electrical actuation has occurred, to function as an automatic time-delay circuit-breaker.

As only several volts are needed to power this embodiment of my game toy, and as the heaviest current drain—the motor—is on for the shortest time, and the lightest current drain—the lights—are normally on for the longest time, the batteries may be relatively small, such as in a pen-sized flashlight, although larger batteries can be used. Rechargeable batteries may be provided, along with a charging circuit, and a rectifier may be included for operation from a household electrical outlet, if desired.

Preferred embodiments and variants of the reaction-time game toy of the present invention have been shown and described. Other changes may be made in such apparatus and procedures, as by adding or deleting, subdividing or combining, or otherwise modifying parts or steps, while retaining at least some of the many advantages and benefits of this invention—which itself is defined only in the following claims.

The claimed invention is:

1. Competitive game toy, comprising drive means including a motor traversing triggered indicator means along a given path, light means located along such path and lighted sequentially as the indicator means passes therealong, and stop means manually actuated to halt the indicator means therealong with an indicator light so lighted.

2. Toy according to claim 1, including manual trigger means for the drive means to traverse such indicator means along such path.

3. Toy according to claim 1, including award means adjacent successive light means.

4. Toy according to claim 1, wherein such award means includes at path intervals specific play instructions for a game.

5. Competitive game toy comprising drive means traversing triggered indicator means along a given horizontal path, a row of indicator lights along such path and individually lighted when the indicator means is adjacent thereto, stop means manually actuated to halt the means along the path, and award means adjacent successive indicator lights

6. Toy according to claim 5, including means for resetting the drive means.

7. Competitive game toy for one or more players, comprising indicator means traversable along a given path, two rows of successive indicator lights flanking such given path traversed simultaneously thereby and individually adapted to light when such indicator means is adjacent thereto, drive means triggerable to traverse such indicator means in a forward or run direction, stop means manually actuated to halt the indicator means on the path while an indicator light is lighted in at least one of the rows along the path, and reset means to traverse the indicator means in the opposite or reset direction.

8. Toy according to claim 7, including award means adjacent such path and extending therealong, in position to be lighted by such indicator lights.

9. Toy according to claim 8, wherein such award means include game instructions at intervals lighted by the respective lights.

10. Toy according to claim 9, wherein such game is a simulated sport, and such instructions are for plays conventional therein.

11. Competitive electromechanical game toy for one or more players, comprising electrical drive means triggerable to traverse indicator means along a row of electrically actuated light means to light the same in sequence by establishing an electrical circuit thereto, trigger means manually actuated to trigger the drive means, stop means manually actuated to halt the indicator means, and reset means manually actuated to reset the indicator means.

12. Toy according to claim 11, wherein such trigger means comprises an electrical switch in a circuit to such drive means.

13. Toy according to claim 11, wherein such drive means comprises an electrical switch in a circuit to such drive means.

14. Toy according to claim 11, wherein such drive means comprises an electrical motor and a ratchet mechanism adapted to maintain such indicator means in its halted position until reset.

15. Toy according to claim 14, wherein such ratchet means includes a ratchet gear and a disengageably engageable pawl, and such reset means comprises electrical means to disengage the pawl.

16. Toy according to claim 15, wherein such electrical means comprises an electrical switch in a circuit to a pawl-disengaging solenoid.

17. Competitive game playing for one or more players, comprising the steps of manually triggering drive means to traverse indicator means electrically along a given path;

visually observing light means successively lighted, in accordance with the traversing of such indicator means, along a given scale divided into successive length intervals; and manually actuating electrical stop means to halt such indicator means at a given location so as to light certain of the light means.

18. Game playing according to claim 17, including performing a subsequent step pursuant to an instruction located adjacent the stopping place of the indicator means.

19. Game playing according to claim 18, wherein the subsequent step corresponds to a play in a simulated conventional sport.

20. Game playing according to claim 19, including manually actuating electrical reset means and thereby traversing the indicator means in the opposite or reset direction in preparation for another run.

21. Game playing according to claim 20, wherein the manual triggering of the drive means and actuating of the reset means both include depressing the same push-button.

* * * * *